US005713326A

United States Patent [19]

Huber

[11] Patent Number: 5,713,326

[45] Date of Patent: Feb. 3, 1998

[54] INJECTION NOZZLE

[75] Inventor: Gerd Huber, Munich, Germany

[73] Assignee: Institut fur Motorenbau Prof. Huber GmbH, Munich, Germany

[21] Appl. No.: 642,606

[22] Filed: May 3, 1996

[30] Foreign Application Priority Data

May 3, 1995 [DE] Germany ..... 195 16 245.5
Nov. 9, 1995 [DE] Germany ..... 195 41 819.0

[51] Int. Cl.[6] ..... F02B 3/12; F02D 41/40; F02M 45/08

[52] U.S. Cl. ..... 123/299; 123/447; 123/467

[58] Field of Search ..... 123/299, 300, 123/446, 447, 467

[56] References Cited

U.S. PATENT DOCUMENTS

| | | | |
|---|---|---|---|
| 4,022,166 | 5/1977 | Bart . | |
| 5,241,935 | 9/1993 | Beck et al. | 123/467 |
| 5,467,754 | 11/1995 | Beck et al. | 123/467 |
| 5,529,024 | 6/1996 | Wirbeleit et al. | 123/447 |
| 5,605,134 | 2/1997 | Martin | 123/467 |

FOREIGN PATENT DOCUMENTS

| | | |
|---|---|---|
| 0 199 632 A1 | 10/1986 | European Pat. Off. . |
| 0 647 780 A2 | 4/1995 | European Pat. Off. . |
| 20 28 442 | 12/1971 | Germany . |
| 40 11 782 C2 | 3/1991 | Germany . |
| 44 04 050 C1 | 12/1994 | Germany . |
| 44 34 892 A1 | 4/1996 | Germany . |
| 195 16 245 A1 | 11/1996 | Germany . |

OTHER PUBLICATIONS

Krafthand, Heft 5, Mar. 12, 1994, Einspritzsysteme fur umweltfreundliche Dieselmotoren, Gonke–Iris Langkabel.

*Primary Examiner*—Willis R. Wolfe
*Attorney, Agent, or Firm*—Lalos & Keegan

[57] ABSTRACT

An injection nozzle for use in a common-rail system includes a nozzle body with an actuator piston. In the closed condition of the nozzle the nozzle body bears against a seat and upstream of the seat delimits a nozzle chamber communicated with the high-pressure line of the common-rail system. A working chamber of the actuator piston is communicated with the high-pressure line by way of a feed throttle means, the active surface area of the actuator piston being larger than the surface area of the nozzle body which is effective in the nozzle chamber. A return line leads from the working chamber through a return valve. An actuating means is operated by an electrical signal for actuating the valve member of the return valve. The actuating means is a means which displaces the return valve member in analog relationship with the electrical signal so that the return valve forms in the return line a throttle of variable cross-section.

11 Claims, 4 Drawing Sheets

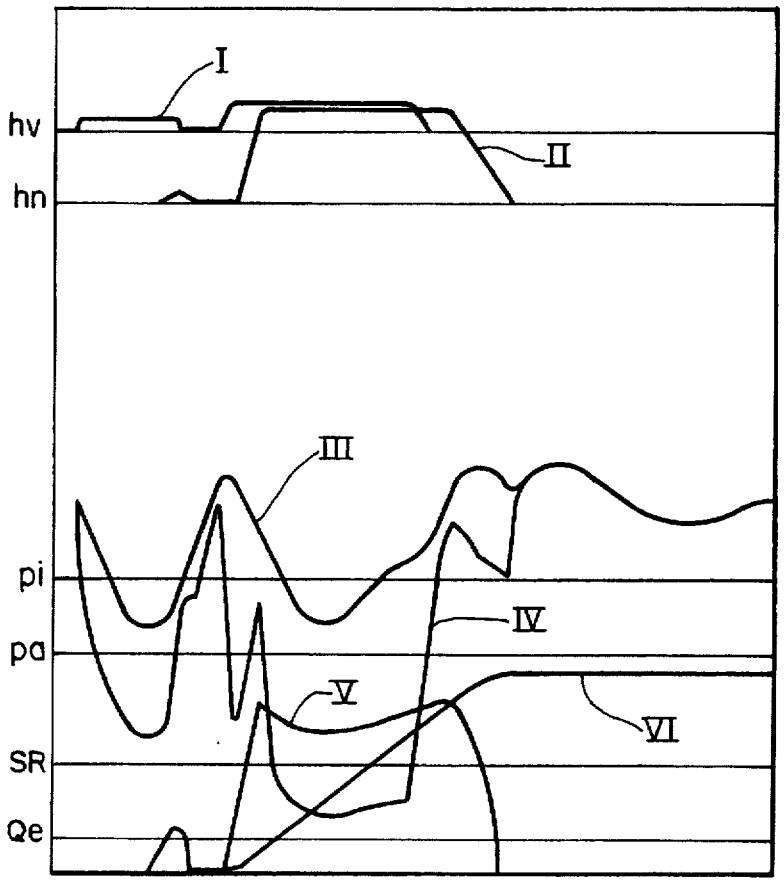
FIG. 4
FIG. 5
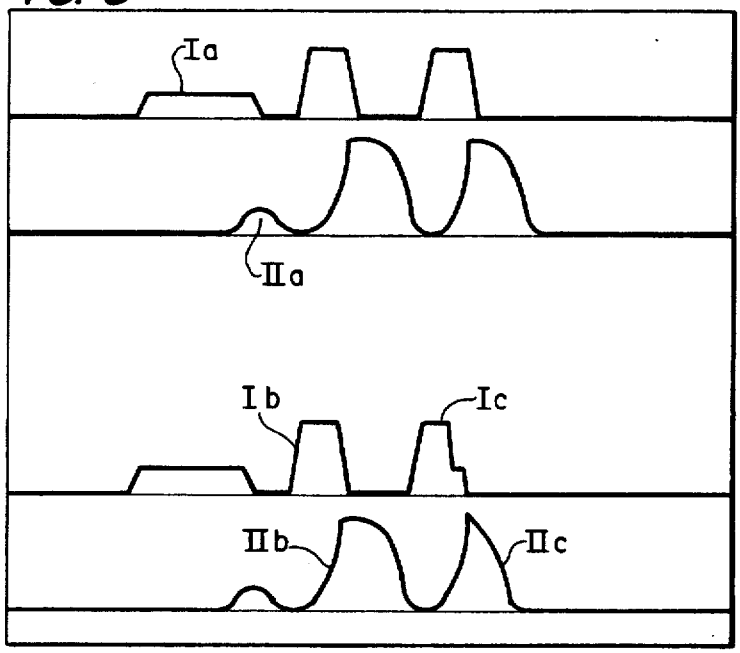

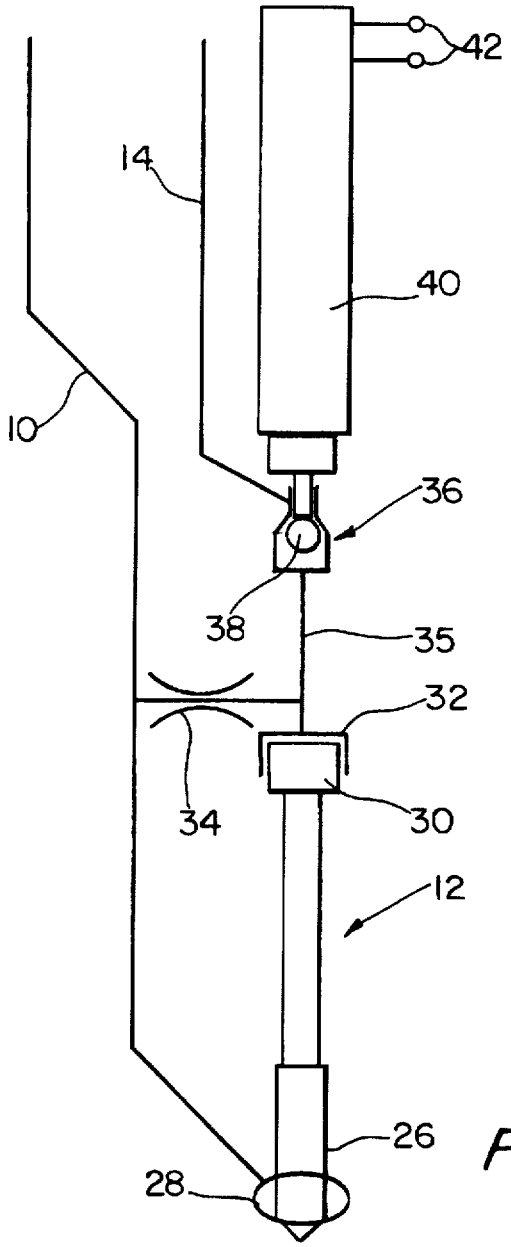
FIG. 6
FIG. 7
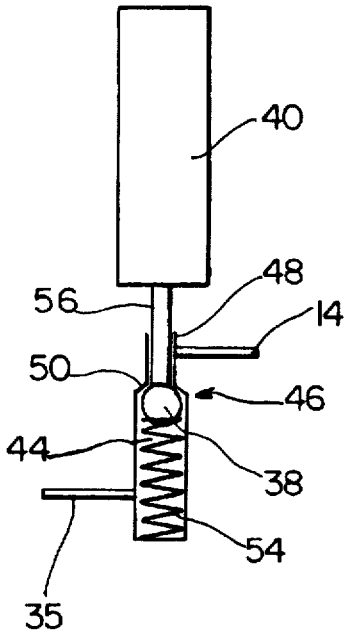

INJECTION NOZZLE

FIELD OF THE INVENTION

The invention concerns an injection nozzle for use in a common-rail system.

BACKGROUND OF THE INVENTION

The tern 'common-rail' is used generally to denote systems whose aim on the one hand is to make the injection pressure of the system independent of the engine speed and the amount of fuel injected and on the other hand to increase the mean injection pressure. A major feature of a common-rail system therefore lies in decoupling of the generation of pressure and fuel injection by means of a storage volume which is composed of the volume of a common high-pressure distributor line (the common rail) connected to the injection nozzles of a multi-cylinder engine, together with the feed lines to the injection nozzles and the volumes available in the nozzles themselves.

Such common-rail injection systems for Diesel engines are descried for example in the Progress Reports relating to the 15th Vienna Engine Symposium of VDI Verlag, series 12/No 205 (1994), pages 36 through 53 to which attention is therefore directed.

In one form of an injection nozzle for use in a common-rail system, the nozzle comprises a nozzle body having an actuator piston or plunger. In the closed condition of the injection nozzle the nozzle body bears against a seat and, upstream thereof, defines a nozzle chamber communicated with the high-pressure line of the common-rail system. A working chamber of the actuator piston is communicated with the high-pressure line by way of a feed throttle means, the active surface area of the actuator piston being larger than the surface area of the nozzle body which is effective in the nozzle chamber. A return line passes from the working chamber of the actuator piston through a return opening of a return valve, while an actuating means is operated by an electrical signal for actuating the valve member of the return valve.

The injection procedure in that arrangement is controlled by an electromagnetically operated valve integrated in the injection nozzle. Direct control of the nozzle body or the nozzle needle for controlling the fuel injection could hitherto not be achieved either by means of an electromagnetically operated valve or by means of piezoelectric or magnetostrictive actuators.

The return valve which is in the form of an electromagnetic valve has two defined positions, a closed position and a fully open position, by virtue of magnetic actuation thereof. So that the injection nozzle does not open too rapidly when the return valve is opened, by means of the electromagnetic actuator thereof, disposed downstream of the return valve is a return throttle means. The characteristic in respect of time of the injection nozzle is established by suitable matching of the fuel feed throttle action to the return throttle action. A small cross-section of the return throttle means involves, upon opening of the return valve, a slow pressure drop across the working piston and thus a good capability for very small amounts of fuel injection on the part of the injection nozzle, which is advantageous in regard to pre-injection. At the same time however a small return throttle means cross-section involves a long minimum interval between two successive injection phases as a comparatively long period of time elapses between opening of the return valve and the pressure drop across the actuator piston. Systems with a small return throttle means cross-section are therefore suitable for pre-injection involving very small amounts of fuel and greatly delayed main injection or post-injection.

A large return throttle means cross-section involves worse capability for the injection of small amounts of fuel, because of the rapid full opening of the injection nozzle, but it produces faster opening of the nozzle body or nozzle needle and thus permits shorter intervals between successive injections. A large return throttle means diameter is therefore suitable for one or more main injections.

SUMMARY OF THE INVENTION

An object of the present invention is to provide an injection nozzle for use in a common-rail system, which affords good capability for injecting small amounts for pre-injection and which also permits fast main injection subsequent to pre-injection or a cyclically controlled main injection.

Another object of the present invention is to propose an injection nozzle for use in a common-rail system, which affords sensitivity of control in terms of fuel injection in accordance with the respective operating requirements involved.

Still another object of the present invention is to provide an injection nozzle for use in a common-rail system, which permits a higher degree of injection efficiency and accordingly better operation of the engine on which the system is used.

Yet another object of the present invention is to provide an injection nozzle for a common-rail system, which is capable of operating in such a way as to reduce polluting emissions from the engine on which the system is employed.

In accordance with the principles of the present invention the foregoing and other objects are achieved by an injection nozzle for use in a common-rail system, comprising a nozzle body which is provided with an actuator piston or plunger and which in the closed condition of the injection nozzle bears against the seat. Upstream of the seat the nozzle body defines a nozzle chamber which is communicated with the high-pressure line of the common-rail system. A working space or chamber associated with the actuator piston is communicated with the high-pressure line of the system by way of a feed throttle means, and the active surface area of the actuator piston is larger than the surface area of the nozzle body which is effective in the nozzle chamber. A return line extends from the working chamber of the actuator piston through a return opening of a return valve, and an actuating means operated by an electrical signal is adapted to actuate the valve member of the return valve. The actuating means is a means for displacing the valve member of the return valve in analog relationship with the electrical signal so that the return valve forms a throttle means of variable cross-section in the return line.

As will be seen from the following detailed description of preferred embodiments of the injection nozzle according to the invention, the fact that the valve member of the return valve can be opened in analog relationship with the electrical signal, that is to say variably in a manner corresponding to the electrical signal, the return valve itself can form a variable return throttle cross-section so that the injection nozzle can be adapted in the optimum fashion to the respective requirements involved. Overall the injection nozzle according to the invention, by suitable actuation of the return valve, can provide for a good capability for injecting very small amounts of fuel for satisfactory pre-injection, as well as main injection which follows pre-injection quickly and which is possibly operated in a cyclic fashion. That can contribute to achieving progressive combustion with low soot values and low nitrogen oxide values, while at the same time affording a high degree of overall efficiency.

In a preferred feature of the invention the actuating means is a piezoelectrically operating means. Because the actuating means does not directly actuate the nozzle body but the return valve, comparatively short stroke movements are sufficient for operation of the injection nozzle, as are produced with piezoelectric actuators.

A further preferred feature of the invention provides that the effective cross-section of the opening of the return valve varies approximately proportionally to the stroke movement of the valve member of the return valve, at least at the beginning of valve opening. That configuration for the injection nozzle can be particularly accurately controlled.

In accordance with another preferred feature of the invention the valve member of the return valve is arranged on the side, which is towards the return line, of an opening of the return valve which is closable by the valve member. That construction affords the particular consideration that the valve member of the return valve, which for example is in the form of a flat valve, when in the closed position thereof and thus when the injection nozzle is closed, must be continuously held against the valve seat, against the high system pressure which is operative in the working chamber of the actuator piston.

In accordance with another preferred feature of the invention the valve member is arranged in a valve chamber of the return valve, which valve chamber is connected by way of a communicating line to the working chamber of the actuator piston and through a return opening to the return line. An actuating member, adapted to be actuated by the actuating means, for the valve member, projects through the return opening, while a valve seat co-operating with the valve member is such that, on bearing against the valve seat, the valve member closes the communication from the valve chamber to the return line. That arrangement provides that the valve member is held in contact against the valve seat by the high pressure which acts thereon from the working chamber of the actuator piston, so that the level of energy consumption is reduced and operational reliability is enhanced. In the event of a defect in the actuating means therefore when the system pressure builds up the valve member comes to bear increasingly firmly against the valve seat whereby the injection valve remains reliably closed and no fuel is injected.

In another preferred feature the valve member can bear against the valve seat in the rest condition of a piezoelectric actuator of the actuating means, while another preferred feature provides that the valve member is in the form of a ball.

In accordance with the principles of the present invention the foregoing and other objects are also achieved by a method of controlling multi-phase injection in a direct-injection Diesel engine using an injection nozzle according to the invention, wherein the electrical signal for the actuating means for the return valve is held at a low value for pre-injection with a small amount of fuel injected and is held at a higher value after being switched off for closing the injection nozzle for subsequent main injection with a larger amount of fuel injected.

In another form of the method according to the invention of controlling multi-phase injection of a direct-injection Diesel engine using an injection nozzle according to the invention, the electrical signal for the actuating means for the return valve is held at a high value for a first period for opening of the injection nozzle and is then held at a high value with the injection nozzle open, and then, with the injection nozzle open, is held at a lower value for preparation for more rapid closure of the injection nozzle.

The first-mentioned form of the method according to the invention provides that main injection can quickly follow pre-injection, while the features of the modified form of the method according to the invention provide that the injection nozzle closes extremely quickly, which is advantageous in terms of combustion.

Further objects, features and advantages of the present invention will be apparent from the following description of preferred embodiments.

BRIEF DESCRIPTION OF THE DRAWING

FIG. 4 shows the configurations in respect of stroke movement, pressure and through-put involved in injection of fuel, using an injection nozzle according to the invention, FIG. 5 shows configurations in respect of stroke movements of two control methods, FIG. 6 shows the hydraulic circuit diagram of a modified embodiment of an injection nozzle according to the invention, FIG. 7 shows a diagrammatic view of the return valve used in the FIG. 6 structure.

DESCRIPTION OF PREFERRED EMBODIMENTS

Figure 1:
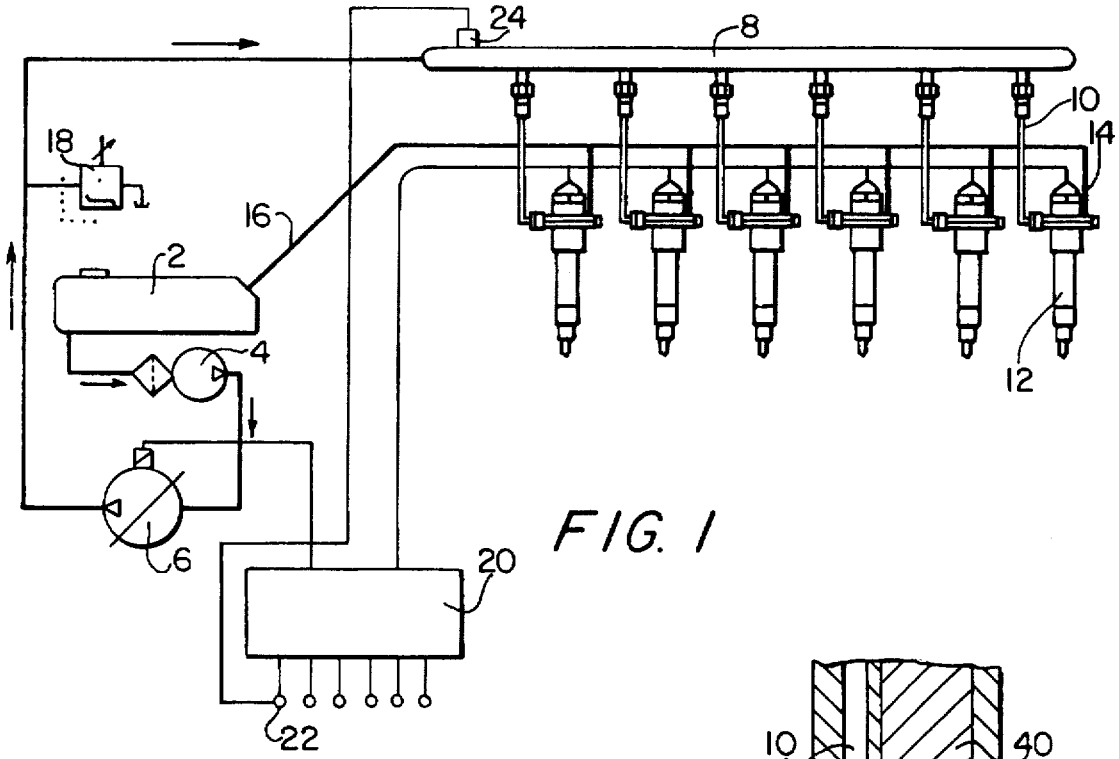
FIG. 1 is an overall diagrammatic view of a common-rail system.

Referring firstly to FIG. 1, reference numeral 2 denotes a fuel tank which is connected by way of a filter (not shown) and a pre-delivery pump 4 to a common-rail high-pressure pump 6. From the high-pressure pump 6, a line goes to a distributor line, referred to as the common rail 8, which is communicated by way of feed lines 10 with the respective injection nozzles 12 associated with each cylinder of a multi-cylinder internal combustion engine.

The injection nozzles 12 are communicated by way of return lines 14 with a return line 16 which leads back to the tank 2.

The system pressure is limited by means of a restrictor valve 18 and can be up to 2000 bars.

An electronic control device 20 is connected by means of its outputs to the high-pressure pump 6 and to the injection nozzles 12. The inputs 22 of control device 20 are connected to a pressure sensor 24 in the common rail 8 and further sensors (not shown), for example for sensing the position of a control pedal such as the accelerator pedal, the speed of travel, temperatures, charge pressure, air mass, engine speed and the like.

Figure 2:
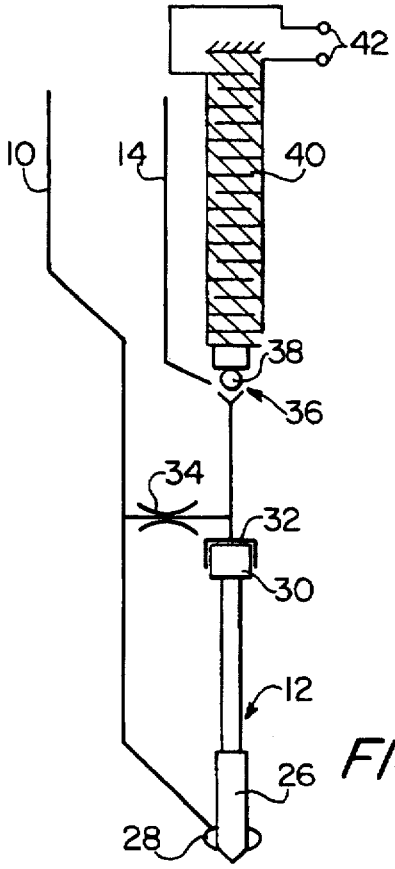
FIG. 2 shows the hydraulic circuit diagram of an injection nozzle according to the invention.

Reference will now be made to FIG. 2 showing the structure in principle of an injection nozzle according to the invention with the associated hydraulic circuit in diagrammatic form.

The injection nozzle 12 includes a nozzle body 26 terminating in a nozzle needle which, in the closed condition of the injection nozzle, bears against a valve seat (not referenced). The nozzle body 26 passes through a nozzle chamber 28 which is communicated with the line 10.

The nozzle body 26 is connected to or is formed integrally with an actuator piston or plunger 30 which operates in a working chamber 32 which is communicated with the feed line 10 by way of a feed throttle means 34. The working chamber 32 is further communicated with the return line 14 by way of a return valve diagrammatically indicated at 36 in FIG. 2.

For actuation of the return valve 36 the valve member 38 thereof is connected to an actuating means which is in the form of a piezoelectric actuator diagrammatically indicated at 40 and which is connected by way of its terminals 42 to the control device indicated at 20 in FIG. 1.

Such piezoelectric actuators are known per se and are of a similar structure to capacitors whose dielectric comprises piezoelectric material, for example lead-zirconate-titanate ceramic. Modern actuators operate with field strengths of up to 2000 V/mm and achieve relative variations in length of up to 1.5°/oo. In the illustrated embodiment, with the piezoelectric actuator 40 being about 100 mm in length, it is thus possible to produce a defined stroke movement of over 0.1 mm; that is entirely sufficient for a variation, in analog relationship, in respect of the cross-section of the opening of the return valve 36, in dependence on the voltage at the terminals 42.

Alternatively the piezoelectric actuator 40 could also be a magnetostrictive actuator in which magnetostrictive material is arranged within a coil through which a current flows.

Figure 3:
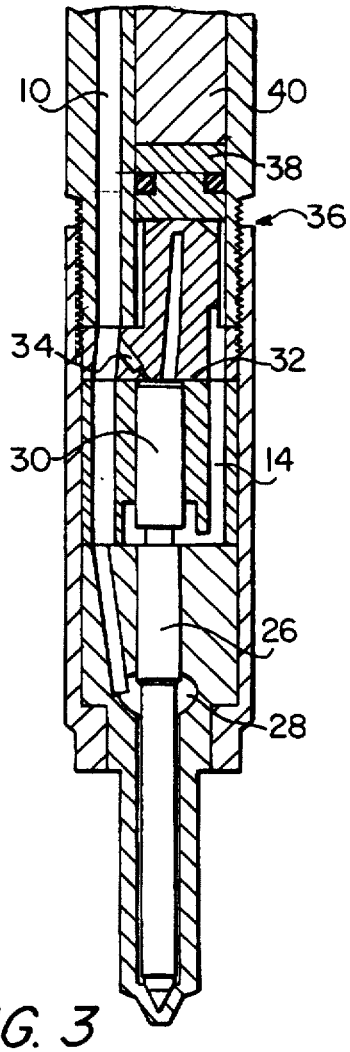
FIG. 3 is a view in section through a front portion of an injection nozzle according to the invention.

Reference is now made to FIG. 3 showing a view in section through a practical embodiment of an injection nozzle. The construction of the nozzle needle and the co-operation thereof with the seat are known per se, for example as described in 'Kraftfahrtechnische Taschenbuch', Bosch, VDI Verlag 1991, page 509, to which reference is therefore directed.

The important consideration is that the effective or active surface area with which the actuator piston 30 is acted upon in the working chamber 32 is larger than the effective or active surface area with which the nozzle body 26 is acted upon in the nozzle chamber 28 or the nozzle needle, upstream of the valve seat, so that the nozzle body 26 is urged into the closed position of the injector nozzle when the pressures in the working chamber 32 and in the nozzle chamber 28 are the same.

The structure of the injection nozzle according to the invention having been described hereinbefore, the mode of operation thereof will now be set forth, as follows:

When the return valve 36 is closed, the pressure which obtains in the feed line 10 and which urges the nozzle body 26 into the closed position of the injection nozzle occurs in the working chamber 32 and in the nozzle chamber 28. When the valve member 38 of the return valve 36 is opened by the piezoelectric actuator 40 being supplied with voltage, the pressure escapes from the working chamber 32, when the return valve 36 is sufficient wide open, more quickly than fuel can flow towards the injection nozzle through the feed throttle means 34, so that, as the pressure in the working chamber 32 falls, the nozzle opens as a result of the pressure in the nozzle chamber 28. When the return valve 36 is closed, the high pressure in the working chamber 32 is restored again so that the injection nozzle closes.

The total pressure level in the feed line 10 can be detected by the pressure sensor 24 in dependence on the respective operating conditions involved and can be altered, under the control of the control device 20, by suitable control of the high-pressure pump 6.

Reference will now be made to FIG. 4 showing measurement records of an actuating method, wherein:

curve I denotes the stroke movement hv of the valve member 38, which is proportional to the voltage at the terminals 20, in which respect the shorter stroke movement is for example 0.03 mm and the larger stroke movement is for example 0.06 mm, curve II denotes the stroke movement hn of the nozzle body 26 or the nozzle needle, curve III denotes the pressure pi in the nozzle chamber 28, curve IV denotes the pressure pa in the working chamber 32, curve V denotes the injection rate SR, that is to say the flow in respect of volume of fuel issuing from the injection nozzle, and curve VI denotes the integrated injection amount Qe.

In the illustrated embodiment the diameter of the feed throttle means 34 was for example 0.30 mm and the bore diameter of the return valve 36 (FIG. 3) was for example 0.7 mm.

As can be clearly seen from the configuration of curves I and II, opening of the injection nozzle or the stroke movement of the nozzle body 36 follows the short stroke movement of the valve member 38 of the return valve 36 with a long delay so as to ensure a gentle beginning to pre-injection. The end of pre-injection immediately follows the end of the application of voltage to the piezoelectric actuator 40 or closure of the return valve 36. That therefore affords an excellent capability of providing for very small amounts of fuel injection, insofar as the return valve 36 acts like a small return throttle, by virtue of the small stroke movement of the valve member 38. If now the return valve 36 is further opened by the piezoelectric actuator 40 being more strongly supplied with voltage, then the injection valve opens with a shorter delay relative to opening of the return valve 36 which now operates as a throttle of considerably larger cross-section. Closure of the injection valve and thus termination of main injection follows closure of the return valve 36 but now with a greater delay as the full pressure must firstly build up again in the working chamber 32, insofar as the fuel flows through the feed throttle means 34.

In FIG. 5, curves Ia and IIa correspond to the curves I and II in FIG. 4. As will be apparent from the configurations in FIG. 5, main injection occurs here in a cyclic fashion insofar as the return valve 36 is actuated in such a way that the nozzle body 26 always closes again as soon as it has reached approximately its full stroke movement.

Curves Ib, IIb and Ic, IIc in FIG. 5 show a comparison of a cycle of a main injection phase in which the return valve 36 is opened once with constant amplitude of movement (curve Ib) and the other time the amplitude of opening of the return valve 36 is adjusted to a reduced value as soon as opening of the injection nozzle has begun or the nozzle body 26 has lifted substantially away from its seat. It will be seen that control of the return valve 36, as indicated by the curve Ic, results in faster closure of the injection nozzle after closure of the return valve 36, and that is advantageous in regard to the combustion procedure in the engine supplied by the injection nozzle.

FIG. 6 shows the hydraulic circuit diagram of an embodiment of an injection nozzle according to the invention, which is somewhat modified in comparison with that shown in FIG. 2. In FIG. 6, the same reference numerals are used to denote components which are the save from the functional point of view. The essential difference in relation to FIG. 2 is that, in the FIG. 2 embodiment, the valve member 38 is arranged on the downstream side of the seat of the return valve 36 and must therefore be continuously urged into the closed position to close the valve against the high system pressure, whereas in the embodiment shown in FIG. 6 the valve member 38 is arranged in front of the valve seat in the flow direction. The remainder of the structure shown in FIG. 6 does not need to be described in full detail herein as such a description of the FIG. 6 arrangement will be clearly apparent by comparison with the structure already shown in FIG. 2.

FIG. 7 shows the operating circuit in diagrammatic form of the return valve 36 shown in FIG. 6.

A valve chamber 44 has a connecting opening for the connection of the connecting line 35, and a return opening 46 by way of which the valve chamber 44 goes into a chamber 48 connected to the return line 14. The return opening 46 is of such a configuration that the edge thereof forms a valve seat 50 for the valve member 38 which is in the form of a ball. The ball is urged into contact against the valve seat 50 by a spring 54. For the purposes of actuation of the ball 38, an actuating member 56 which is connected to the piezoelectric actuator 40 projects through the chamber or space 48 and the return opening 46. As shown in FIG. 4, the actuating member 56 is passed in sealing relationship in the space or chamber 48 downstream of the location at which the return line 14 branches off.

Figure 8:
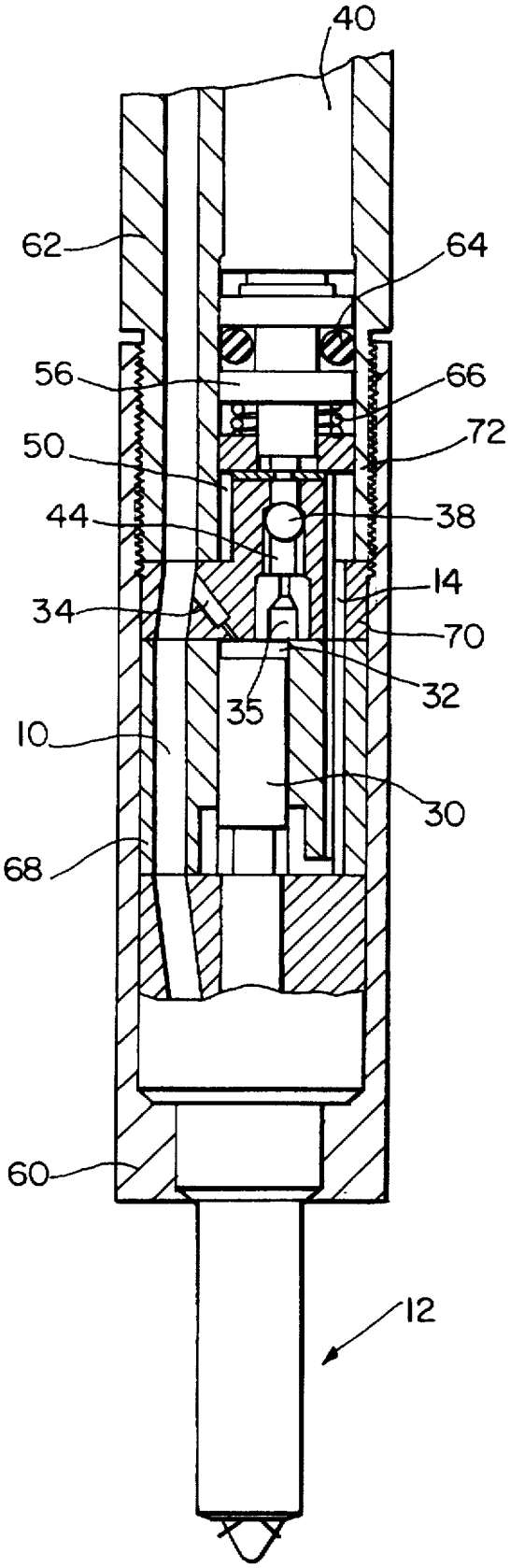
FIG. 8 is a view in section through the front portion of the injection nozzle shown in FIG. 6.

FIG. 8 is a view in section through an embodiment of an injection nozzle, wherein the structure of the nozzle needle and the co-operation thereof with the seat are known per se, for example as described in above-mentioned 'Kraftfahrtechnische Taschenbuch', Bosch, VDI Verlag 1991, page 509.

Looking still at FIG. 8, a housing sleeve 60 which terminates in the injection nozzle 12 is screwed to a further housing portion 62. The piezoelectric actuator 40, with an actuating member 56, is accommodated in a bore in the housing portion 62 in which the feed line 10 is also provided. The actuating member 56 is sealed relative to the piezoelectric actuator 40 by means of a seal 64 and operates against a spring 66, by means of a flange (not referenced).

The housing sleeve 60 and the housing portion 62 grip between them two further housing bodies indicated generally at 68 and 70 respectively. The actuator piston 30 operates in the housing body 68 while the feed throttle means 34 is provided in the other housing body 70. In addition the housing body 70 has a multiple-stepped through bore which forms the communicating conduit 35, the valve chamber 44, the return opening 46 (as indicated in FIG. 7) with the valve seat 50 and the chamber 48 (as shown in FIG. 7) from which the return line 14 extends. The actuating member 56 passes through the chamber 48 which is formed in the upper end of the through bore in the housing body 70, with a projection 72 which is of smaller diameter or which is provided at its outside surface with grooves and which actuates the ball 38 through the return opening indicated at 46 in FIG. 7. The return line 14 branches from an annular space or chamber which is formed by an enlarged step in the bore at the end of the through bore in the housing body 70, which is the upper end in FIG. 8.

The mode of operation of the arrangement just described is as follows:

When the piezoelectric actuator 40 has no power flowing thereto, the actuating member 56 projects into the return opening 46 to such an extent that it is not in engagement with the ball 52 which is urged into contact against the valve seat 50 by the spring 54. When the system pressure builds up in the feed line 10, the ball 52 is additionally urged into contact against the valve seat 50 by the system pressure so that the return valve 36 is reliably closed and therewith the entire injection nozzle is also reliably closed.

When power is supplied to the piezoelectric actuator 40 for electrical actuation thereof, the ball 52 is lifted off the valve seat 50 against the system pressure and the spring force, by means of the actuating member 56, whereupon the pressure in the working chamber of the actuator piston falls and the injection nozzle injects fuel. That injection operation can be accurately controlled in the appropriate manner described above. The requirements made in respect of the seal indicated at 64 in FIG. 4, which seals off the guide arrangement for the actuating member 56 relative to the space or chamber 48, are not high as that seal is not subjected to the high system pressure in any condition of the assembly.

It will be appreciated that the operating method described with reference to FIGS. 4 and 5 can be performed to particular advantage with the embodiment of the injection nozzle shown in FIG. 6.

It will further be appreciated that the above-described injection nozzle and method of controlling multi-phase injection in accordance with the invention have been set forth solely by way of example and illustration of the principles of the invention and that various modifications and alterations may be made therein without thereby departing from the spirit and scope of the invention.

What is claimed is:

1. A method of controlling multi-phase injection of a direct-injection Diesel engine using an injection nozzle for use in a common-rail system, including: a seat; a nozzle body movable between an open position of the nozzle and a closed position of bearing against the seat, the nozzle body delimiting upstream of the seat a nozzle chamber which in use is communicated with a high-pressure line of the common-rail system; an actuator piston for moving the nozzle body; a working chamber of the actuator piston; means communicating said working chamber with said high-pressure line, said communicating means including a feed throttle means; wherein the actuator piston has an active surface area which is larger than the surface area of the nozzle body which is effective in the nozzle chamber; a return valve having a return opening and a return valve member; a return line leading from the working chamber through the return opening of the return valve; and an actuating means adapted to be operated by an electrical signal for actuating the valve member of the return valve, the actuating means comprising a means operable to displace the valve member of the return valve in analog relationship with the electrical signal so that the return valve forms a throttle which is of variable cross-section in the return line wherein the electrical signal for the actuating means of the return valve is held at a low value for pre-injection with a small injection amount and is held at a higher value after being switched off for closure of the injection nozzle for subsequent main injection with a larger injection amount.

2. A method of controlling multi-phase injection of a direct-injection Diesel engine using an injection nozzle for use in a common-rail system, including: a seat; a nozzle body movable between an open position of the nozzle and a closed position of bearing against the seat, the nozzle body delimiting upstream of the seat a nozzle chamber which in use is communicated with a high-pressure line of the common-rail system; an actuator piston for moving the nozzle body; a working chamber of the actuator piston; means communicating said working chamber with said high-pressure line, said communicating means including a feed throttle means; wherein the actuator piston has an active surface area which is larger than the surface area of the nozzle body which is effective in the nozzle chamber; a return valve having a return opening and a return valve member; a return line leading from the working chamber through the return opening of the return valve; and an actuating means adapted to be operated by an electrical signal for actuating the valve member of the return valve, the actuating means comprising a means operable to displace the valve member of the return valve in analog relationship with the electrical signal so that the return valve forms a throttle which is of variable cross-section in the return line wherein the electrical signal for the actuating means of the return valve is held at a high value during a first period for opening of the injection nozzle and is then held at a high value with the injection nozzle open, and then with the injection nozzle open is held at a lower value for preparation for more rapid closure of the injection nozzle.

3. An injection nozzle for use in a common-rail system, including: a seat; a nozzle body movable between an open position of the nozzle and a closed position of bearing against the seat, the nozzle body delimiting upstream of the seat a nozzle chamber which in use is communicated with a high-pressure line of the common-rail system; an actuator piston for moving the nozzle body; a working chamber of the actuator piston; means communicating said working chamber with said high-pressure line, said communicating means including a feed throttle means; wherein the actuator piston has an active surface area which is larger than the surface area of the nozzle body which is effective in the nozzle chamber; a return valve having a return opening and a return valve member; a return line leading from the working chamber through the return opening of the return valve; and an actuating means adapted to be operated by an electrical signal for actuating the valve member of the return valve, the actuating means comprising a means operable to displace the valve member of the return valve in analog relationship with the electrical signal so that the return valve forms a throttle which is of variable cross-section in the return line.

4. An injection nozzle as set forth in claim 3 wherein the actuating means is a piezoelectrically operating means.

5. An injection nozzle as set forth in claim 3 wherein the effective opening cross-section of the return valve is changeable approximately proportionally to the stroke movement of the valve member at least at the beginning of opening of the return valve.

6. An injection nozzle as set forth in claim 3 wherein the valve member of the return valve is arranged on the side, which is towards the return line, of the opening of the return valve, which is closable by the valve member.

7. A method of controlling multi-phase injection of a direct-injection Diesel engine using an injection nozzle as set forth in claim 3, wherein the electrical signal for the actuating means of the return valve is held at a low value for pre-injection with a small injection amount and is held at a higher value after being switched off for closure of the injection nozzle for subsequent main injection with a larger injection amount.

8. A method of controlling multi-phase injection of a direct-injection Diesel engine using an injection nozzle as set forth in claim 3 wherein the electrical signal for the actuating means of the return valve is held at a high value during a first period for opening of the injection nozzle and is then held at a high value with the injection nozzle open, and then with the injection nozzle open is held at a lower value for preparation for more rapid closure of the injection nozzle.

9. An injection nozzle as set forth in claim 3 wherein the return valve has a valve chamber and the valve member of the return valve is arranged in the valve chamber of the return valve, and further including a communicating conduit means connecting the valve chamber to the working chamber and through a return opening to the return line, an actuating member adapted to be actuated by the actuating means for the valve member and projecting through the return opening, and a valve seat co-operable with the valve member and of such a configuration that, upon bearing against the valve seat, the valve member closes the communication from the valve chamber to the return line.

10. An injection nozzle as set forth in claim 9 wherein the actuating means includes a piezoelectric actuator and the valve member is adapted to bear against the valve seat in the rest condition of the piezoelectric actuator of the actuating means.

11. An injection nozzle as set forth in claim 9 wherein the valve member is in the form of a ball.

* * * * *